United States Patent [19]

Talwar et al.

[11] Patent Number: 4,878,849

[45] Date of Patent: Nov. 7, 1989

[54] ELECTRICAL CONNECTOR HAVING MULTI-POSITION HOUSING

[75] Inventors: Anil K. Talwar, Schaumburg; Joseph Warywoda, Chicago, both of Ill.

[73] Assignee: Amphenol Corporation, Wallingford, Conn.

[21] Appl. No.: 187,985

[22] Filed: Apr. 29, 1988

[51] Int. Cl.[4] ..... H01R 0/00

[52] U.S. Cl. ..... 439/79; 439/76; 29/842

[58] Field of Search ..... 439/76, 45, 79–81, 439/603, 629; 29/829, 837, 838, 842, 844, 845, 882, 884

[56] References Cited

U.S. PATENT DOCUMENTS 3,697,933 10/1972 Black et al. ..... 439/80
4,116,520 9/1978 Zimmerman et al. ..... 439/79
4,597,625 7/1986 Seidler ..... 439/76
4,756,696 7/1988 Whiteman, Jr. ..... 439/79

*Primary Examiner*—P. Austin Bradley
*Attorney, Agent, or Firm*—Bacon & Thomas

[57] ABSTRACT

A housing for an electrical connector is described which may be utilized in either a vertical or horizontal orientation. The housing defines openings extending generally parallel to each other such that the openings open through a first side of the housing. Contact pins are inserted into the openings in the housing such that a contact tail portion extends beyond the plane of the first side of the housing. The housing may also provide apertures in an opposite side to facilitate insertion of the contact tails of a device to be joined to the connector. First and second rows of bosses are formed on the housing such that they extend beyond the plane of the housing's first side.

20 Claims, 1 Drawing Sheet

FIG 1
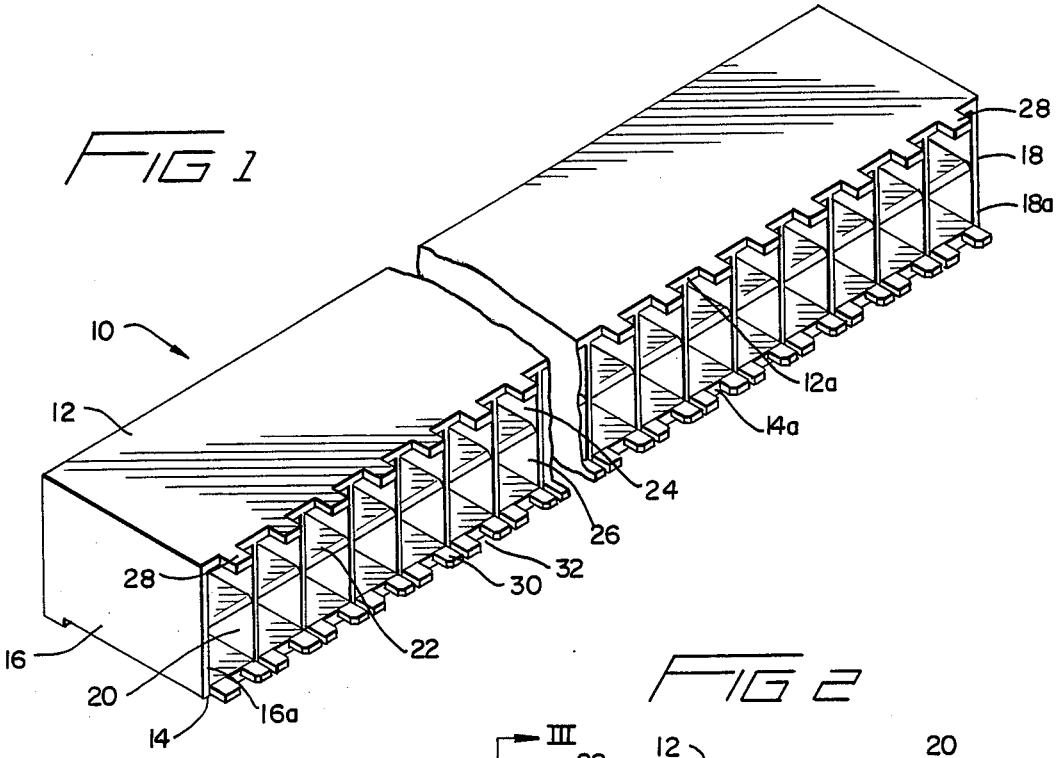
FIG 2
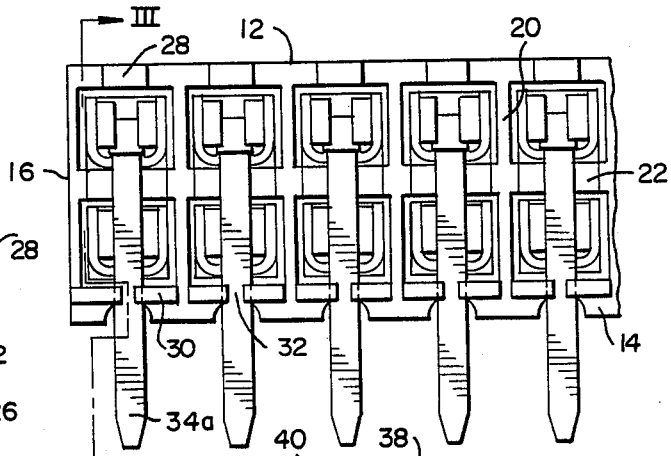
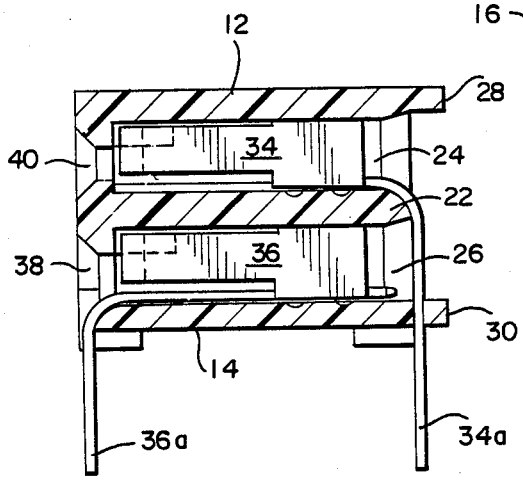
FIG 3
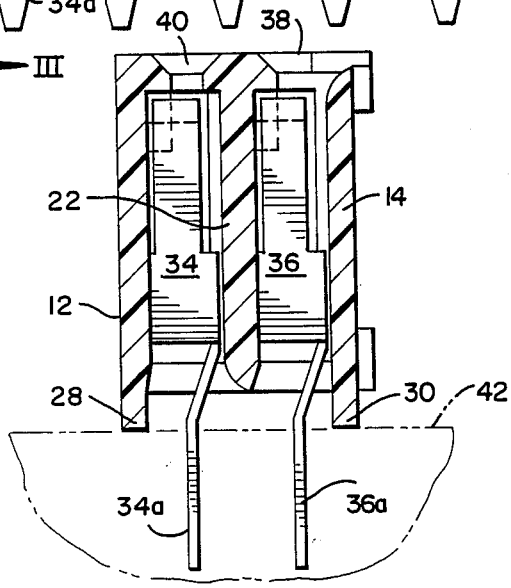
FIG 4

ELECTRICAL CONNECTOR HAVING MULTI-POSITION HOUSING

BACKGROUND OF THE INVENTION

The present invention relates to an electrical connector, particularly an electrical connector having a housing which may be used in a variety of positions.

Electrical connectors, particularly those utilized to interconnect printed circuit boards with other printed circuit boards, are well known in the art. Typically such connectors comprise a housing made of plastic or other electrically insulating material having a plurality of electrical contacts mounted in the housing. The electrical contacts are formed such that contact tails extend from the connector for attachment to the printed circuit board.

The great variety of electrical devices utilizing printed circuit boards in use today requires electrical connectors to be used in a variety of orientations. The interconnection of the printed circuit board with either another board or a cable may require the female portions of the connector to have a horizontal orientation, while in other instances, it may be necessary for them to be oriented vertically. The prior art typically required separate connector housings to be utilized to each orientation of the connector. The requirement for separate housings has served to increase manufacturing costs for the connectors and has increased the inventory problems of the users of such connectors since they are required to have separate connectors for each orientation.

The prior art devices have also evidenced difficulties in inserting the contact tail portions of the connectors in a corresponding female connector. Typically, such connectors have a large number of connector pins and connector tails. Due to the small size of the connector pins and the corresponding tail portions, the tail portions are usually very easily deformed. Obviously, should a number of the tail portions become deformed, the connection between the elements will be rendered difficult, if not impossible. The prior art has attempted to overcome the problem or deforming or movement of the tails with respect to the housing such as "floating" by providing them with stiffening ribs. However, the ribs have a tendency to weaken the tails causing them to break rather easily.

SUMMARY OF THE INVENTION

The present invention provides a housing for an electrical connector which may be utilized in either a vertical or horizontal orientation. The housing defines a plurality of openings extending generally parallel to each other such that the openings open through a first side of the housing. Contact pins are inserted into the openings in the housing such that a contact tail portion extends beyond the plane of the first side of the housing. The housing may also provide apertures in an opposite side to facilitate insertion of the contact tails of a device to be joined to the connector.

First and second rows of bosses are formed on the housing such that they extend beyond the plane of the housing's first side. When the housing is used in a vertical orientation, the contact pins are inserted into the openings such that all of the contact tail portions extend beyond the first side of the housing. When the tails are inserted into a corresponding female portion of an electrical device, the bosses bears against the surface of such a device to act as standoff bosses.

The housing defines two rows of openings for the contact pins, the first row being adjacent to the first row of bosses, while the second row of openings lies adjacent to the second row of bosses. When the housing is used for connectors having horizontal orientations, the connector pins are typically inserted into the second row of openings such that their contact tail portions extend through an opposite side of the housing. Connector pins are inserted into the first row of openings such that their contact tail portions extend outwardly from the first side of the housing. The contact tail portions of all of the connector pins are then bent downwardly such that they extend generally parallel to the plane of the first side of the housing. The contact tail portions of the contact pins in the first row of openings extend between adjacent bosses in the second row of bosses. These bosses are then heat staked and deformed slightly over the contact tail portions to hold them in place and prevent any contact tail "float" with respect to the connector housing. This serves to hold the contact tail portions in position and reduce any deformation during connection of the connector to a second device.

BRIEF DESCRIPTION OF THE DRAWINGS

FIG. 1 is a schematic view of the connector housing according to the invention.

FIG. 2 is a partial, side view of an electrical connector in a horizontal mode according to the invention.

FIG. 3 is a cross-sectional view taken along line III—III in FIG. 2.

FIG. 4 is a cross-sectional view similar to that shown in FIG. 3, but illustrating the electrical connector used in the vertical mode.

DETAILED DESCRIPTION OF THE PREFERRED EMBODIMENT

The housing according to the present invention is illustrated in FIG. 1 at 10 and comprises first wall 12 and second wall 14 extending generally parallel to each other and joined together by end walls 16 and 18. A plurality of partition walls 20 extend between walls 12 and 14 so as to divide the interior of housing 10 into a plurality of openings extending generally parallel to each other. The openings are further sub-divided by generally horizontally extending partition wall 22 such that the housing defines a first row of openings 24 and a second row of openings 26. Openings 24 and 26 open through a generally planar, first side of the housing defined by edges 12*a*, 14*a*, 16*a*, and 18*a* of the housing walls 12 and 14, and end walls 16 and 18.

A first row of bosses 28 extend from edge 12*a* of first wall 12 in a direction generally perpendicular to the plane of the first side of the housing. The first row of bosses 28 is adjacent to the first row of openings 24. A second row of bosses 30 extends from edge 14*a* of wall 14 in a direction generally parallel to the first row of bosses 28 and generally perpendicular to the plane of the first side of housing 10. Bosses 28 are located such that each boss is aligned with an opening 24. Bosses 30 are positioned such that a pair of bosses are aligned with each opening 26, the bosses defining a space 32 therebetween for each of the openings 24 or 26.

Openings 24 and 26 are designed to accommodate contact pins 34 and 36. When the connector is intended to be utilized in the horizontal mode as illustrated in FIGS. 2 and 3, the contact pins 36 are inserted into openings 26 such that the contact tail portions 36*a* extend through aperture 38 formed in a second side of housing 10. Contact pins 34 are inserted into openings 24 such that their contact tail portions 34*a* extend through the first side of the housing. Each of the contact pins 34 and 36 has a generally "U"-shaped body section which is inserted into the openings 24 or 26 and is retained therein by known means. Apertures 40 defined by housing 10 are aligned with each of the openings 24 and facilitate the insertion of contact pins from a second electrical device to be connected to the connector. A similar function is performed by apertures 38 which are aligned with openings 26.

After the contact pins 34 and 36 have been inserted into their respective openings, the contact tail portions 34*a* and 34*a* are bent downwardly approximately 90 degrees so as to extend generally parallel to the first side of the housing. When contact tail portions 34*a* are deformed downwardly, they extend into spaces 32 between adjacent bosses 30 in the second row of bosses. Bosses 30 are then deformed by a heat staking process over a portion of the contact tail portion 34*a* so as to rigidly hold the tail portion in position and prevent any "float" with respect to the housing.

When it is desired to form an electrical connector used in a vertical mode, the contact pins 34 and 36 are each inserted into their respective openings such that the contact tail portions 34*a* and 36 *a* both extend from the first side of the housing, as illustrated in FIG. 4. In this mode, the apertures 38 and 40 facilitate the insertion of the male portion of a second electrical device to be connected to the connector in contact with contact pins 34 and 36. In this mode, bosses 28 and 30 bear against a surface of a device 42 shown in phantom lines in FIG. 4, to which the connector is attached and function as standoffs.

The foregoing description is provided for illustrative purposes only and should not be construed as in any way limiting this invention, the scope of which is defined solely by the appended claims.

What is claimed is:

1. An electrical connector comprising:

(a) a housing defining a first, generally planar side and defining a plurality of openings arranged in first and second rows extending generally parallel to each other and opening through the first side;

(b) a plurality of bosses formed on the housing in first and second rows and extending beyond the plane of the first side of the housing; and (c) electrical contact pins inserted into the plurality of openings, each contact pin having a contact tail portion extending from the housing wherein said bosses in the second row of bosses are deformable so as to be capable of holding therebetween the contact tail portions of the contacts extending from the first side of the housing.

2. The connector according to claim 1 wherein the first row of bosses lie in a first common plane and the second row of bosses lie in a second common plane displaced from the first common plane.

3. The connector according to claim 2 wherein the first and second common planes are substantially parallel to each other.

4. The connector according to claim 3 wherein the first and second common planes extend generally perpendicular to the plane of the first side of the housing.

5. The connector according to claim 4 wherein the contact tail portion of at least one contact pin extends between adjacent bosses in the second row.

6. The connector according to claim 4 wherein the housing defines first and second rows of openings such that the first row of bosses are located adjacent to the first row of openings and the second row of bosses are located adjacent to the second row of openings.

7. The connector according to claim 6 wherein the contact tail portions of the contact pins located in the first row of openings extend between adjacent bosses in the second row of bosses.

8. A housing for a printed circuit board connector comprising:

(a) first and second walls extending generally parallel to each other;

(b) end walls interconnecting the first and second walls;

(c) at least one partition wall extending between the first and second walls so as to define a plurality of openings adapted to receive electrical contact pins;

(d) a first row of bosses extending from the first wall and being substantially co-planar therewith; and (e) a second row of bosses extending from the second wall and being substantially co-planar therewith, wherein adjacent bosses in the second row of bosses are spaced apart and deformable so as to be capable of receiving and holding a contact tail portion of a contact pin therebetween.

9. A method of making an electrical connector comprising the steps of:

(a) forming a connector housing defining a plurality of openings arranged in first and second rows extending generally parallel to each other and opening through a first, generally planar side of the housing;

(b) forming a plurality of bosses on the housing in first and second rows, the bosses extending beyond the plane of the first side;

(c) inserting an electrical contact pin having a contact tail portion in each of the openings in the housing such that the contact tail portions extend from the openings in the housing, (d) bending the contact tail portions of the contacts extending beyond the plane of the first side of the housing such that they extend between adjacent bosses in the second row of bosses; and (e) heat staking the bosses in the second row of bosses so as to hold the contact tail portions therebetween.

10. The method according to claim 9 comprising the step of forming the bosses such that they extend substantially perpendicular to the plane of the first side of the housing.

11. The method according to claim 9 comprising the additional steps of:

(a) forming electrical contact pins having a contact tail portion; and, (b) inserting the electricl contact pins in the openings defined by the housing such that the contact tail portions extend beyond the plane of the first side of the housing.

12. The method according to claim 9 comprising the additional steps of:

(a) forming electrical contact pins having a contact tail portion;

(b) inserting the electrical contact pins into the openings defined by the housing such that at least one contact tail portions extends beyond the plane of the first side of the housing; and, (c) bending the contact tail portion extending beyond the plane of the first side of the housing such that it extends generally parallel to the plane of the first side.

13. The method according to claim 9 wherein the step of forming the plurality of bosses comprises:

(a) forming a first row of bosses; and (b) forming a second row of bosses displaced from the first row.

14. The method according to claim 13 further comprising forming the bosses in the first row so as to lie in a first common plane.

15. The method according to claim 14 further comprising forming the bosses in the second row so as to lie in a second common plane.

16. The method according to claim 15 further comprising forming the first and second common planes substantially parallel to each other.

17. The method according to claim 16 further comprising forming the first and second common planes so as to extend substantially perpendicular to the plane of the first side of the housing.

18. The method according to claim 17 comprising the additional step of:

(a) forming electrical contact pins having a contact tail portion; and, (b) inserting the electrical contact pins in the openings defined by the housing such that the contact tail portions extend beyond the plane of the first side of the housing.

19. The method according to claim 9 further comprising forming the first row of bosses adjacent to the first row of openings and forming the second row of bosses adjacent to the second row of openings.

20. The method according to claim 19 wherein the step of bending the contact tail portions comprises bending the contact tail portions of the electrical contact pins inserted into the first row of openings such that they extend between adjacent bosses in the second row of bosses.

* * * * *